US005967517A

United States Patent [19]

Villano

[11] Patent Number: 5,967,517

[45] Date of Patent: Oct. 19, 1999

[54] CARD GAME METHOD

[75] Inventor: Jean-Francois Villano, 410 E. 74th St. Apt. 5 G, NY, N.Y. 10021

[73] Assignee: Jean-Francois Villano, New York, N.Y.

[21] Appl. No.: 08/996,464

[22] Filed: Dec. 22, 1997

[51] Int. Cl.[6] ..... A63F 1/00

[52] U.S. Cl. ..... 273/292

[58] Field of Search ..... 273/292, 303, 273/304, 305, 306

[56] References Cited

U.S. PATENT DOCUMENTS

| | | | |
|---|---|---|---|
| 4,273,337 | 6/1981 | Carrera | 273/243 |
| 5,054,775 | 10/1991 | Banks | 273/431 |
| 5,230,517 | 7/1993 | Peacock | 273/432 |
| 5,375,846 | 12/1994 | Smith | 273/292 |
| 5,785,606 | 7/1998 | Marquez | 273/292 |
| 5,816,577 | 10/1998 | Preston et al. | 273/292 |
| 5,816,916 | 10/1998 | Moody | 273/292 X |
| 5,829,750 | 11/1998 | Booker | 273/292 |

*Primary Examiner*—William E. Stoll

[57] ABSTRACT

A card game apparatus comprising: a first set of cards each having imprinted on one side thereof indicia representing a subcategory thereof, each card further having imprinted on one side thereof indicia representing a point value thereof; a second set of cards appearing in a deck with the first set of cards, each having imprinted on one side thereof indicia representing a subcategory thereof, each card further having imprinted on one side thereof indicia representing a point value thereof; at least one modifying card appearing in a deck with the first set of cards and the second set of cards, the modifying cards functioning to alter the effectiveness of cards in the first set and cards in the second set; at least one remedy card appearing in at least one additional deck adjacent to a deck of the first set of cards and the second set of cards, the remedy cards functioning to alter the effectiveness of the first cards and second cards so as to counteract the function of the corresponding modifying cards.

5 Claims, 4 Drawing Sheets

CARD GAME METHOD

BACKGROUND OF THE INVENTION

1. Field of the Invention

The present invention relates to a card game. More particularly, the present invention relates to a card game, wherein the game for adults can be played by two to six people, or by two to three couples. The object of the game in the preferred mode is to get the players acquainted with the various emotional and sexual aspects of relationships between genders or sexual preferences.

2. Description of the Prior Art

Several innovations for card games have been provided in the prior art that are described as follows. Even though these innovations may be suitable for the specific individual purposes to which they address, they differ from the present invention as hereinafter contrasted.

1. U.S. Pat. No. 5,375,846, Sexual Etiquette Game Apparatus and Method,—Smith

The patent by Smith discloses a game playing apparatus which includes a set of cards each bearing a descriptive synopsis of a potentially ambiguous or embarrassing situational dilemma involving sexual etiquette. Also provided are a set of role play cards each instructing the players to assume the sexual role indicated symbolically on the card and answer the current question accordingly. Players are dealt four or five dilemma cards each and the role play cars are placed accessibly between the players. Each player in turn reads aloud the situation described on a card and shares his or her opinion on how the dilemma should best be resolved. If the other players are in general agreement with the resolution, the round is over and the next player reads and responds to one of his or her situation cards. If one or more players differ with the resolution posed, the dealer calls for and moderates an open discussion on the merits of alternative solutions. At any time during the discussion period any player may have his or her opinion challenged as sex-biased by any other player and required to rephrase his or her answer from the viewpoint of the opposite sex. Play continues until all dealt cards have been discussed whereupon each player rates himself and each of the other players perceived sexual sensitivity. The player with the highest total is deemed "winner" with the privilege of posing any sexual dilemma of his or her choice to the group.

The present invention is similar to the Smith invention only in that the present invention includes the use of multiple players, cards, and themes including love and sex. The present invention differs from the Smith invention because the present game is for the purpose of matching up couples based upon compatibility, not answering controversial questions.

2. U.S. Pat. No. 5,230,517, Method of Playing a Game For Fostering Personal Relationships,—Peacock The patent by Peacock teaches the use of a game designed to aid in fostering personal relationships using a board, a pair of dice, several stacks of question and command cards, a timer, a box of laxatives, and several other related objects. The purpose of the game is to force the fostering of personal knowledge between couples through the forced answering of random questions dealing with personal relationships upon certain random occurrences.

Although this game, like the present invention, helps bring people together, its means of doing so lie in answering embarrassing or uncomfortable questions, allowing the players to learn more about each other. Thus, the game by Peacock is more for informational purposes than for determining couple compatibility.

3. U.S. Pat. No. 5,054,775, Game Relating To Personal Relationships,—Banks

The patent by Banks, describes a board game including a plurality of stacks of cards. The first stack of cards defining questions cards relating to personal relationships between individuals, wherein a second category of cards is defined by four different categories including "true", "false", "pass", and "challenge". A first player selects a questions card and an associated category card, whereupon response to the question is dependent upon the category chosen. A correct response relative to the category effects a rolling of a plurality of dice by another player to determine a point total for the player correctly responding to the question and the associated category. The player responding to the selected question continues until an incorrect response is solicited. Subsequent to the response to the question and associated category, a second stack of cards for the answered question and the utilized category card is effected.

The present invention is significantly different than that of Banks for much the same reasons it differs from the above-described Smith and Peacock patents. It should be noted that the game by Banks is solely based upon correct and incorrect answers to predetermined questions in order to select a winner.

4. U.S. Pat. No. 4,273,337, Family Sex Education Board Game, Inventor—Carrera

The patent by Carrera, describes a board game apparatus which is intended to facilitate communication between parents and children regarding facts and attitudes in the area of human sexuality and to provide learning experiences which will lead to improved communication between parents and their children and adults and young people. The apparatus includes a plurality of player tokens, a game board having a closed continuous path defined by a multiplicity of playing spaces, and three decks of cards, each of which contains questions concerning the field of human sexuality; the decks being distinguishable from one another according to degree of difficulty. There is also provided a fourth deck of cards which contains discussion questions for discussing various attitudes concerning human sexuality and a score sheet for scoring one's correct answers according to category.

The present invention is significantly different than that of Carrera because the Carrera game is strictly for educational purposes, particularly for usage among those in a parental role and children. The present game, in contrast, is intended for adult players, and once agin is designed to determine compatibility of couples participating in the game.

SUMMARY OF THE INVENTION

As previously stated, this card game for adults can be played by two to six people, or by two to three couples. The object of the game in the preferred mode is to get the players acquainted with the various emotional and sexual aspects of relationships between genders or sexual preferences.

In the preferred mode, a player must, by matching cards representing different aspects of sexuality and winning points for matching these pairs, based upon each card's point value, come up with either well-matched couples named "perfect couples" "or ill-matched couples called "imperfect couples" by drawing cards from a main deck of cards placed in the center of the table.

Each card of each sexual category has a point value defined by a table of values that may be included in the game for convenient reference thereto, the table of values created by increasing order corresponding to sizes and sexual performances along with slidingly increasing point values. Each set of cards matched by a player enable the player to win a predetermined number of points by adding the points of the cards which have been matched together. Those points can then earn the player currency, given to the player by a bank.

BRIEF DESCRIPTION OF THE PREFERRED EMBODIMENT

DETAILED DESCRIPTION OF THE PREFERRED EMBODIMENT

The claims of the present invention outline the unique qualities of the card game herein and its method of operation in an abstract manner, with a preferred mode further detailed and described. It is respectfully submitted that the following description of the preferred mode is presented for purposes of example only, and the specificity to which each card is described, in both its exact function and its exact appearance, need not be the precise manner in which the game is produced.

Figure 1:
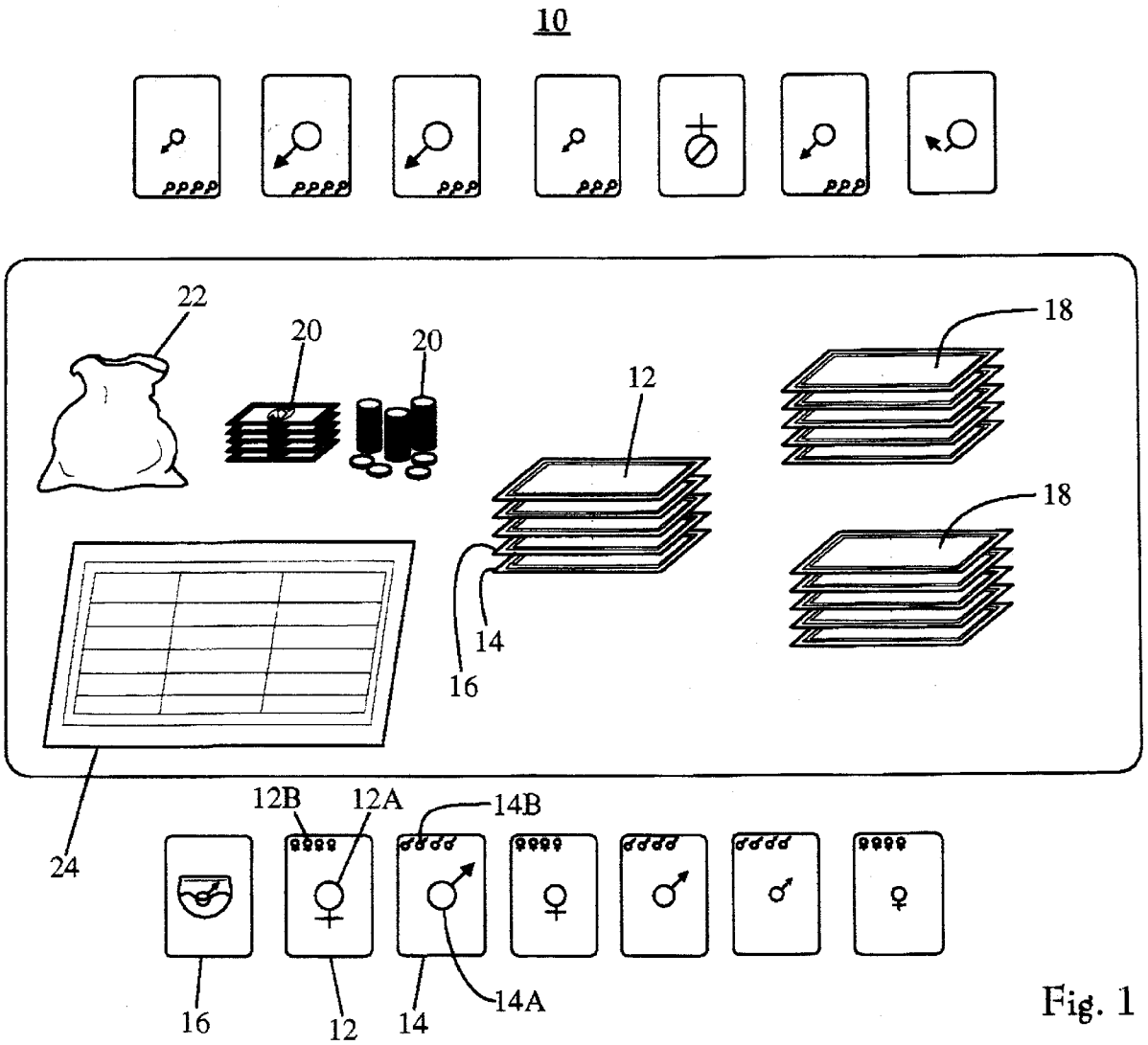
FIG. 1 is a panoramic view from above of the card game with all necessary components, and at least one optional component.

As previously noted, in the preferred mode, a player must, by matching cards representing different aspects of sexuality and winning points for matching these pairs, based upon each card's point value, come up with either well-matched couples named "perfect couples" "or ill-matched couples called "imperfect couples" by drawing cards from a main deck of cards placed in the center of the table. Each card of each sexual category may have a point value defined by a table of values that may be included in the game for convenient reference thereto. Each set of cards matched by a player enable the player to win a predetermined number of points by adding the points of the cards which have been matched together. Those points can then earn the player currency, given to the player by a bank. With the aforementioned in mind, FIG. 1 is a panoramic view from above of the card game with all necessary components, and at least one optional component. Shown in this view are a first set of cards (12) each having imprinted on one side thereof indicia representing a subcategory thereof (12A), each card (12) further having imprinted on one side thereof indicia representing a point value thereof (12B). Also shown is a second set of cards (14) appearing in a deck with the first set of cards, each having imprinted on one side thereof indicia representing a subcategory thereof (14A), each card (14) further having imprinted on one side thereof indicia representing a point value thereof (14B).

Figure 2:
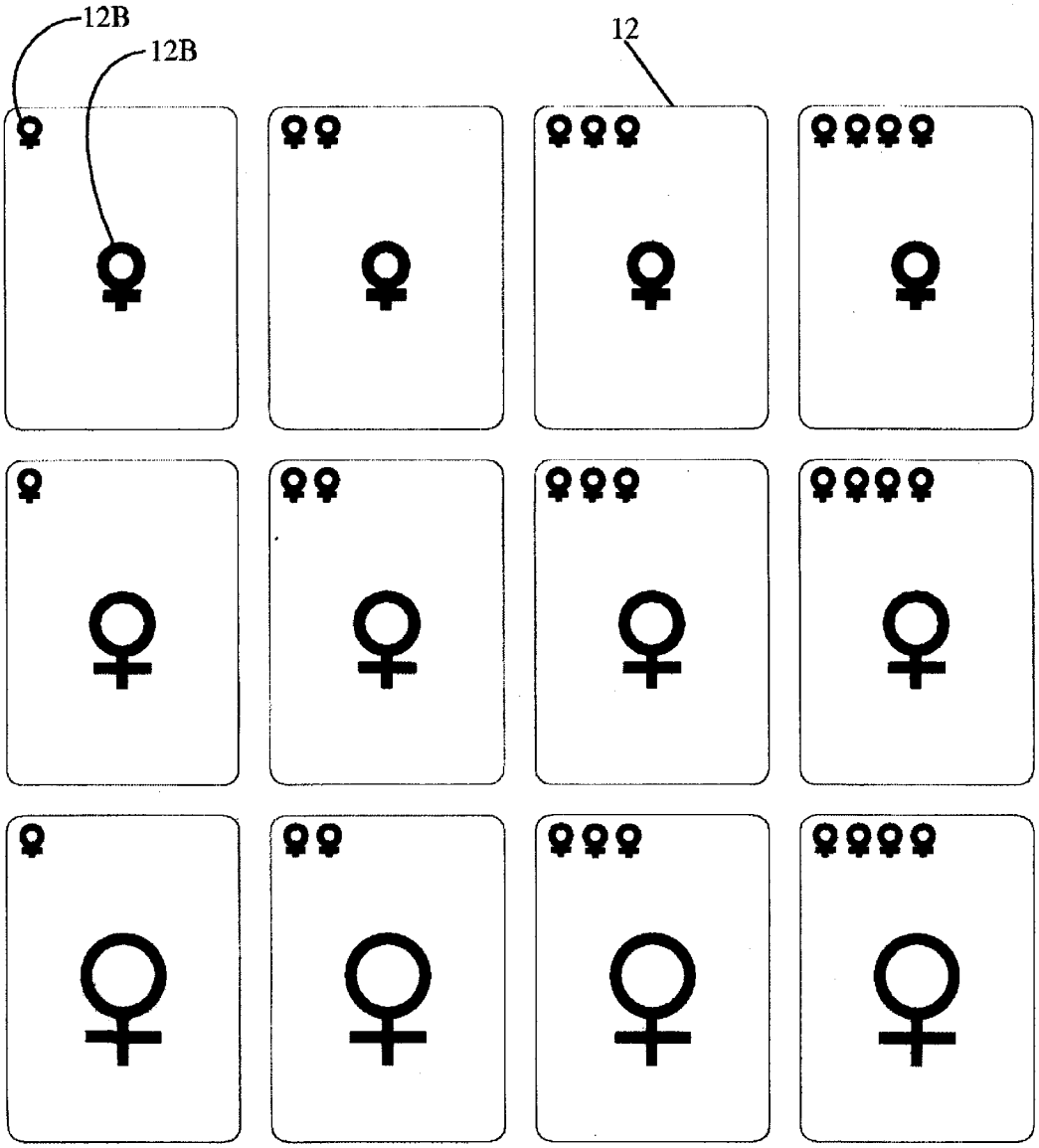
FIG. 2 is a frontal view of an example of a first set of cards, as further described hereinafter.
Figure 3:
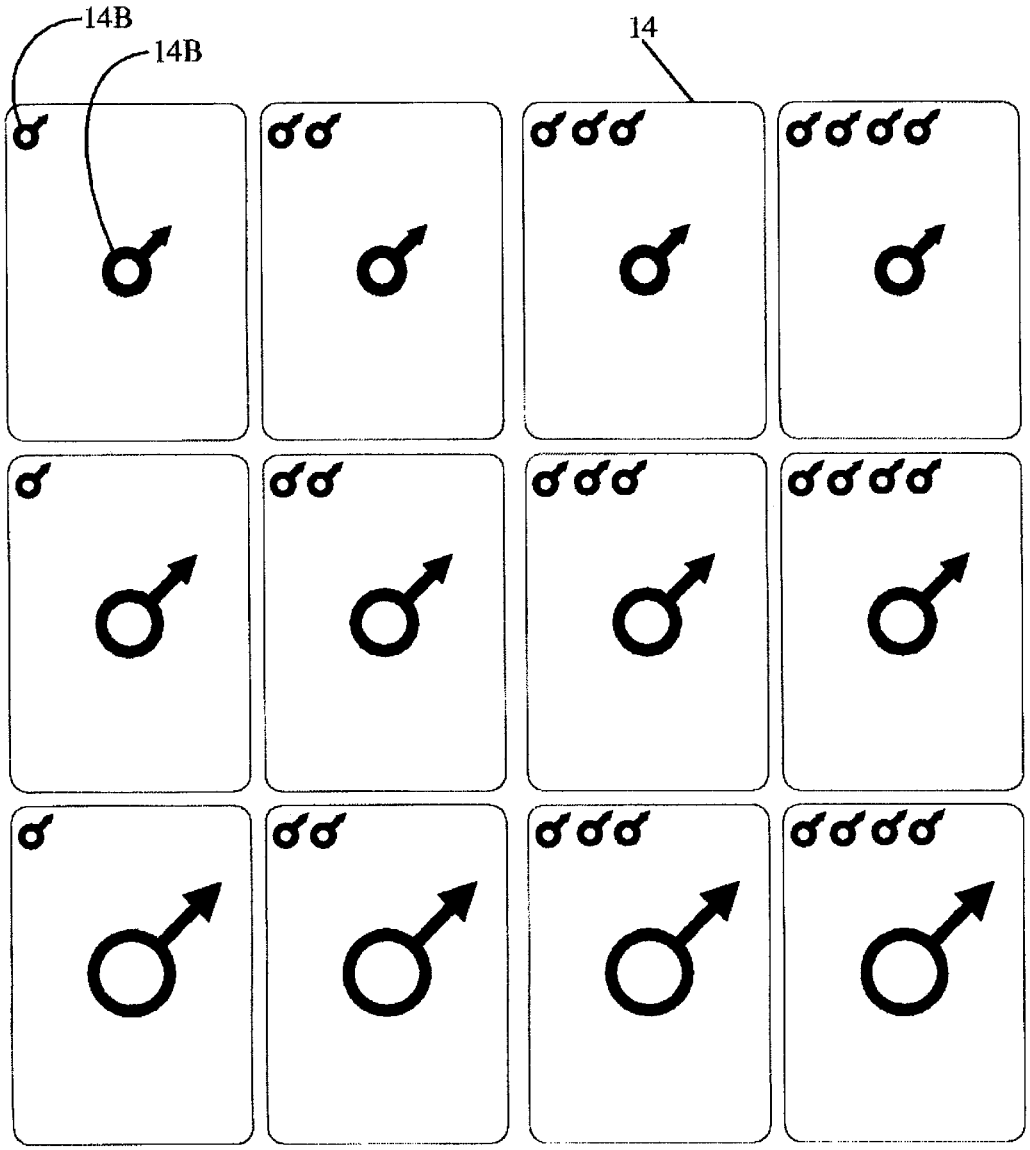
FIG. 3 is a frontal view of an example of a second set of cards, as further described hereinafter.

To be more specific, symbols representing sexual variables in terms of size and performance are what can differentiate one card from another. For instance, three sexual types are used in this primary version of the game and they are defined by three types of males corresponding to three female counterparts. Specifically, the three types could be small-sized female, medium sized female, and large sized female. FIG. 2 is a frontal view of an example of a first set of cards, as further described hereinafter. These correspond with the counterparts of small-sized male, medium sized male, and large sized male. FIG. 3 is a frontal view of an example of a second set of cards, as further described hereinafter. The main symbols used to distinguish male and female cards can be ♂ and ♀ shown respectively on each playing card, as (12A) for the first card and (14A) for the second card, and these symbols themselves could be imprinted on the face of the cards in the above-mentioned three different sizes to represent the specific sexual type of each card.

The game is played by matching cards with masculine and feminine symbols of the same size which are then called "perfect couples." For example: matching a small male sexual organ card with a small size female sexual organ card, matching an average male sexual organ card with an average female sexual organ card, or matching a large male sexual organ card with a large size female sexual organ card.

A second criterion called "sexual performance," as distinguished from six mentioned above, is added to those three different sizes of male and female organs. This sexual performance is represented in the deck of cards by the number of masculine or feminine symbols (♂ and ♀) of the same size shown on the card, preferably at the top portion on the face of each card. In the preferred mode, the number of identical symbols printed on each card goes from a minimum of one to a maximum of four. In all of the FIGURES, the point value indicia, possibly known as sexual performance value in the preferred mode, appear as (12B) for the first type of card and (14B) for the second type of card.

The meaning of the number of the same symbol on a card may be defined as follows: one single masculine or feminine symbol on the same card (♂ or ♀) may indicate male or female with poor sexual performance. Two masculine or feminine symbols on the same card (♂♂ or ♀♀) may mean male or female with average sexual performances. Three masculine or feminine symbols on the same card (♂♂♂ or ♀♀♀) may mean male or female with great sexual performances. Finally, four masculine or feminine symbols on the same card (♂♂♂♂ or ♀♀♀♀) may indicate male or female with exceptional sexual performances.

A player must first match male and female cards of the same type (symbols ♂ and ♀), of the same size as indicated on the card), and then the player must try to win a maximum of points by matching cards with the most symbols of sexual performance, in order to achieve with those "perfect couples" the highest number of points possible using masculine and feminine symbol cards of the highest value.

Next, each male and female card of each sexual size category (small, average, and large size) with each of one, two, three or four symbols (poor, average, great and exceptional performances) has a point value defined by a table of values that may be included in the game for convenient reference thereto. Each set of "perfect couple" or "imperfect couple" cards, which are matched by a player, enable the player to win a predetermined number of points by adding the points of the male card to the points of the female card which have been matched together. Those points can then earn the player currency, which can be referred to as "Love Dollars," given to the player by a bank. The bank may be situated in the center of the game table having many banknotes, paper money, coins or tokens of differing values and colors according to their value. The player exchanges with the bank the cards of the couples he or she has matched against the amount of love dollars defined by the table of values. The discarded cards may then be put in a bag or container included in the game.

A player is also allowed to match "imperfect couples" (of different size symbols). In such a case, the number of points earned results from the value of the male card plus the value of the female card of this "imperfect couple," according to the table of values, divided by two as a penalty for the imperfection of the couple. An imperfect couple consists is defined by matching a small size male or female card with an average size counterpart, or matching an average size male or female card with its large size counterpart. In the preferred mode, matching a small size male or female card with a large size counterpart is not allowed.

Figure 4:
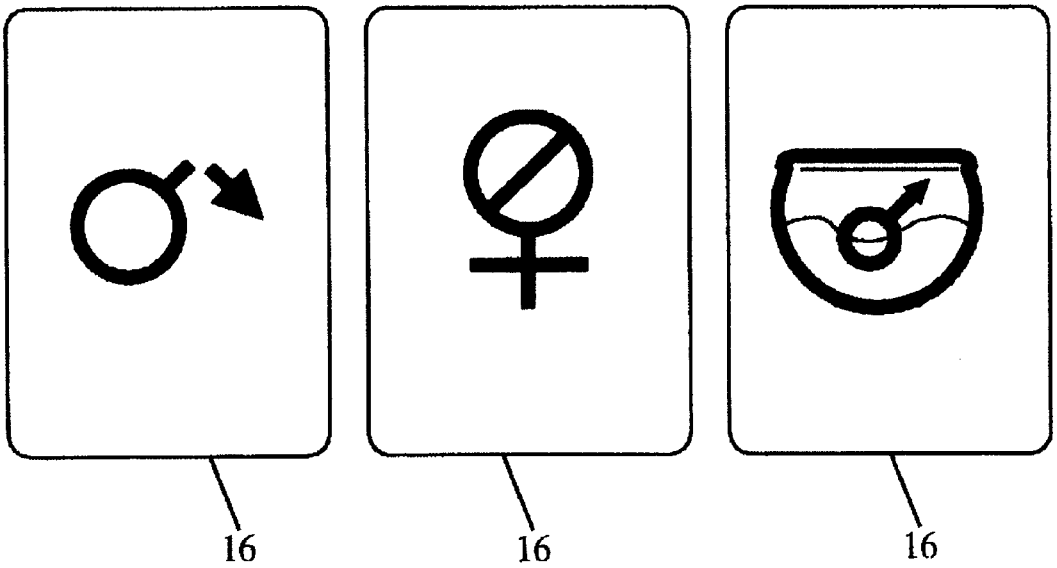
FIG. 4 is a frontal view of an example of modifying cards, as further described hereinafter.

In the main deck of cards, in addition to the male and female cards defined above, there are also modifying cards. The preferred mode includes modifying cards such as an "impotent man" card, a "virgin" card, and a "eunuch" card, functioning as a Joker or wildcard. FIG. 4 is a frontal view of an example of modifying cards, as further described hereinafter. In all such cases, modifying cards appear as (16).

The impotent man card may be represented by the masculine symbol with a broken arrow. If a player draws an "impotent man" card the player's game is blocked. In order to get back in the game, the player must then draw a "remedy" card from the deck and will have to pay the bank a price indicated on the card. Remedy cards appear herein as (18). To "cure" the impotent man effect, the player will draw, at random, one of the several remedy cards which on the back bear the impotent man symbol within a red cross. Each one of these cards has a different value and they are situated in one of the two decks of cards placed adjacent to the central deck of cards. The player who draws the impotent man card must pay the bank the fine shown on the remedy card. After having paid the bank for the remedy card, the player will return the impotent man card and the remedy card to the bank without receiving any funds from the bank, and the player will skip his or her turn, as drawing the impotent man card prevents the player from playing his or her turn.

The virgin card may be represented by the feminine symbol with a diagonal line going across the upper circle symbol. Much like the impotent man card, the virgin card blocks the game of the player who draws it. The player will then have to draw a card at random from one of the two remedy card decks placed adjacent to the main deck, the remedy card drawn having showing the feminine symbol crossed by a diagonal line within a red cross on the back of the card. As in the case of the impotent man, the player has several remedy cards to counteract the effect of the virgin card. Each one of the remedy cards has shows a different price which the player will have to pay to the bank. Much as in the case of the impotent man, the player will return the virgin card and the feminine remedy card to the bank after having paid the fine, and the player will skip his or her turn.

The eunuch card is represented by the masculine symbol floating inside a fishbowl. The eunuch card can be matched with any male or female card. In that case, the eunuch takes the same value as the card with which it is matched, and the bank must then pay the player twice the amount of that card, according to the table of values. The eunuch card cancels the results of drawing the impotent man card or the virgin card. By matching an impotent man or a virgin with the eunuch card, the player returns the two cards to the bank, in this case without paying a fine and the player continues to play without skipping his or her turn.

RULES OF THE GAME

In the preferred mode, seven cards are dealt one by one, clockwise, to the players at the beginning of a game and are lined up horizontally in front of the player, face up in view of the other players. The game may be played by two or more players, preferably with two or three couples taking part.

At the beginning of the game, the first player must try to match as many perfect or imperfect couples as possible according to the above-mentioned criteria. According to the table of values, the player will return to the bank, if the player is able to match them with his or her first seven cards, one or more perfect or imperfect couples, for which the bank will pay the player a predetermined amount corresponding to the value of the couples matched. With seven cards, the variables are that a player may not be able to match even one single couple, or may be able to match one, two, or even three couples. When a player has succeeded in matching one or more couples with the player's initial seven cards, and after having been paid by the bank, the player will draw as many cards from the main deck as the player has returned to the bank. Therefore, if a player has returned only one matched couple of cards to the bank the player will draw two new cards from the main deck so that there are always a total of seven cards in front of the player. The same is true for two or three couples, in which case the player will draw respectively four and six cards from the main deck in order to replace the cards the player has remitted to the bank.

In the second round, after each player has had a turn, each player will draw two additional cards from the main deck and will try to match couples. The player has, therefore, a total of nine cards with which to start the second round and the same total for the remainder of the game. Before skipping a player's turn, a player not able to match one single couple must discard two cards of his choice which he returns to the bank without receiving any love dollars, so that the player still has seven cards in the player's hand. After each player has played at least once, at the beginning of the game, each may buy one card, and only one from the next player (the player who will play immediately after thereafter) but only in the event the player is able to form a perfect couple with that card. In that case, the player who has bought a card from the next player draws only one card from the main deck in order to have only two new cards in the player's hand. In this case, it is the same as if the player had drawn two cards from the main deck and had not bought any card. When a player buys a card from the next player the player pays the latter only half the price of the true value of the card the player purchased from him or her. A player cannot buy a card from the next player to make an imperfect couple match. If a player is in the situation of having to sell a card to the previous player, the player will have only six cards in the player's hand when it is the player's turn to play. In that case the player will have to draw three cards instead of two from the main deck in order to have nine cards in the player's hand when it is the player's turn to play.

When a player draws a card representing the impotent man or the virgin card the player cannot make any couple match unless the player has the eunich card already in the player's hand or draws the eunich card at the same time. If the player does not have or does not draw the eunich card, the player has to draw a remedy card from one of the two decks of remedy cards with a red cross and broken arrow or no parking sign on the back for the impotent man or the virgin card, depending upon which one they need. The player must then immediately pay the bank the price shown on that remedy card which the player has just drawn. If the player does not have the amount shown on that remedy card, the player will have to sell to the bank one or more cards from the player's hand at the price shown on the table of values. In the event the player does not get sufficient currency by selling to the bank one or even all of the player's cards if necessary, the player will have to draw from the deck as many cards as the player has sold to the bank and must sell more cards on the next round until the player has paid off the price of the remedy card. As long a player has not paid the player's debt, the player cannot draw the two additional cards, since the player is selling the cards from his or her hand. In that case the player will have only seven cards in the player's hand instead of nine when it is the player's turn to play.

If a player who was unable to play, draws a eunich card when replacing the cards the player has sold to the bank, the player's debt is immediately canceled. In that case the player returns the eunich card and the impotent man or virgin card to the bank, and is therefore left with only five cards. The player will then draw four cards from the main deck in order to have nine cards, as the other players have, and the player will be able to match couples and play normally on his or her turn.

According to the examples given above, it is obvious that a player should try to match large sizes ♂ and ♀ couples with exceptional sexual performances. Therefore the couple with the highest value will be large size ♂ and ♀ with exceptional sexual performances or four symbols. The first player who reaches a predetermined wins the game. The player will then be entitled to impose a penalty on the loser, the player with the lowest number of points, to execute a forfeit.

It will be understood that each of the elements described above, or two or more together, may also find a useful application in other types of constructions differing from the type described above.

While the invention has been illustrated and described as embodied in a card game apparatus and method, it is not intended to be limited to the details shown, since it will be understood that various omissions, modifications, and changes in the forms and details of the device illustrated and in its operation can be made by those skilled in the art without departing from the spirit of the present invention.

The foregoing will so fully reveal the gist of the present invention that others can, by applying current knowledge, adapt it for various applications without omitting features that, from the standpoint of prior art, constitute essential characteristics of the specific aspects of this invention. What is claimed as new and desired to be protected by Letters Patent is set forth in the appended claims.

REFERENCE NUMERALS UTILIZED IN THE DRAWINGS

10—card game apparatus
12—card in first set
12A—indicia representing subcategory
12B—indicia representing point value
14—card in second set
14A—indicia representing subcategory
14B—indicia representing point value
16—modifying card
18—remedy card
20—currency
22—currency container
24—table of values

What is claimed is:

1. A method of playing a card game, the method comprising:

A) two or more players participating in the game;

B) a hand of cards dealt to each player,

C) each player attempting to match successful couples of cards defined by a first set of cards each having imprinted on one side thereof indicia representing a subcategory thereof, each card further having imprinted on one side thereof indicia representing a point value thereof, and a second set of cards appearing in a deck with the first set of cards, each having imprinted on one side thereof indicia representing a subcategory thereof, each card further having imprinted on one side thereof indicia representing a point value thereof;

D) a player returning a successful couple to a bank, for which the bank will pay the player a predetermined amount of currency corresponding to a predetermined value of the couple matched;

E) after succeeding in matching a couple with the player's initial cards, and being paid by the bank, the player drawing as many cards as the player has returned to the bank, in order to replace the cards the player has remitted to the bank;

F) after each player has had a turn, each player drawing additional cards, and each player trying to match additional couples;

G) a player not able to match a couple discarding cards of the player's choice to the bank without receiving any currency, so that the player still has the same quantity of cards in the player's hand as in the first round;

H) each player buying one card from the player who will play immediately thereafter, provided that the player is able to form a perfect couple with said card;

I) a player buying a card from the next player paying the next player only half of the price of the value of the card;

J) a player drawing a modifying card appearing in a deck with the first set of cards and the second set of cards, the modifying card selected from a group consisting of a virgin card, an impotent man card, a eunich card, a disease card, castration card, sterility card, and virility card, the modifying cards functioning to alter the effectiveness of cards in the first set and cards in the second set, so that the player cannot make any couple match unless the player has a remedy card appearing in at least one additional deck adjacent to a deck of the first set of cards and the second set of cards, the remedy cards functioning to alter the effectiveness of said first cards and second cards so as to counteract the function of said corresponding modifying cards, the player is able to draw a remedy card from at least one deck of remedy cards, the player paying the bank the price shown on the remedy card drawn;

K) the player selling to the bank at least one card from the player's hand at a price indicated on the face thereof if the player does not have the amount shown on the remedy card, the player drawing as many cards as the player has sold to the bank and selling more cards in the next round until the player has paid off the price of the remedy card;

L) a player unable to play drawing a remedy card canceling the player's debt, the player returning the remedy card and the modifying card, the player drawing cards in order to have the same total of cards as the other players have, the player able to match couples and play on the player's next turn;

M) a player reaching a predetermined currency total winning the game and becoming entitled to impose a penalty on the player with the lowest amount of currency.

2. The method of playing a card game described in claim 1, wherein the number of participating players is selected from a range of two to six players.

3. The method of playing a card game described in claim 1, wherein the number of cards distributed each player to commence the first round of play is seven.

4. The method of playing a card game described in claim 1, wherein the number of additional cards distributed each player to commence the second round of play is two.

5. The method of playing a card game described in claim 1, wherein the number of cards discarded by each player unable to form a couple is two.

* * * * *